US007636542B2

(12) United States Patent
Washnock et al.

(10) Patent No.: US 7,636,542 B2
(45) Date of Patent: Dec. 22, 2009

(54) DUPLEXING ADF USING A PAPERPATH SHORTER THAN THE LENGTH OF PAPER TO BE DUPLEXED

(75) Inventors: Gregory P. Washnock, Lexington, KY (US); Gregory T. Webb, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 223 days.

(21) Appl. No.: 11/170,948

(22) Filed: Jun. 30, 2005

(65) Prior Publication Data

US 2007/0003343 A1 Jan. 4, 2007

(51) Int. Cl.
*G03G 15/00* (2006.01)

(52) U.S. Cl. ..... 399/374; 399/367

(58) Field of Classification Search ..... 399/374, 399/367

See application file for complete search history.

(56) References Cited

U.S. PATENT DOCUMENTS

| | | | | |
|---|---|---|---|---|
| 3,141,543 | A * | 7/1964 | Madeira | 198/501 |
| 5,438,435 | A | 8/1995 | Lawniczak | |
| 5,488,464 | A | 1/1996 | Wenthe, Jr. et al. | |
| 5,532,839 | A | 7/1996 | Beikrich et al. | |
| 5,596,399 | A | 1/1997 | Dempsey et al. | |
| 5,689,793 | A | 11/1997 | Kobayashi et al. | |
| 5,710,634 | A | 1/1998 | Kuriyama et al. | |
| 5,784,680 | A | 7/1998 | Taruki | |
| 5,819,152 | A | 10/1998 | Kobayashi et al. | |
| 5,826,155 | A | 10/1998 | Kobayashi et al. | |
| 5,903,811 | A | 5/1999 | Kobayashi et al. | |
| 6,009,303 | A | 12/1999 | Kumagai et al. | |
| 6,088,135 | A | 7/2000 | Kusumoto | |
| 6,134,417 | A * | 10/2000 | Fukasawa | 399/367 |
| 6,307,614 | B1 | 10/2001 | Gaarder et al. | |
| 6,354,589 | B1 * | 3/2002 | Taruki et al. | 271/265.01 |
| 6,393,251 | B2 | 5/2002 | Kono | |
| 6,493,060 | B2 | 12/2002 | Gaarder et al. | |
| 6,530,569 | B2 * | 3/2003 | Yamagishi | 271/270 |
| 6,563,611 | B1 | 5/2003 | Kao | |
| 6,585,252 | B1 * | 7/2003 | Russo et al. | 271/122 |
| 6,674,991 | B2 | 1/2004 | Makino et al. | |
| 6,805,508 | B2 | 10/2004 | Castleberry | |
| 6,862,428 | B2 | 3/2005 | Sasaki | |
| 2002/0054382 | A1 * | 5/2002 | Nanno | 358/498 |

* cited by examiner

*Primary Examiner*—Anthony H. Nguyen
(74) *Attorney, Agent, or Firm*—Middleton Reutlinger

(57) ABSTRACT

An improved apparatus for duplex scanning using a paper path shorter than the length of paper to be duplexed allows a smaller duplexing ADF footprint, without decreasing scan quality. The apparatus includes a friction drive system which allows rollers to rotate with an exit shaft when exit said shaft rotates in a first direction or with a passing media sheet when said exit shaft rotates in a second direction.

21 Claims, 12 Drawing Sheets

DUPLEXING ADF USING A PAPERPATH SHORTER THAN THE LENGTH OF PAPER TO BE DUPLEXED

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates generally to scanners and scanning methods, and more particularly to a duplexing auto-document feeder (ADF) using a paper path shorter than the length of paper to be duplexed.

2. Description of the Related Art

All-in-one machines typically perform functions such as printing, scanning, copying, and faxing in either a stand alone fashion or in conjunction with a personal computer and define a growing market for peripheral devices. These devices eliminate clutter in a business or home office by combining the desirable functionality of various machines into a single unit, while maintaining an affordable cost. Various all-in-one machines currently in the marketplace use thermal inkjet technology as a means for printing received fax documents, original documents, and copied or scanned images or text. Thermal inkjet printing devices utilize consumable inkjet cartridges in fluid communication with a printhead to record text and images on a print media. The printhead typically moves on a carriage relative to the media path and a control system activates the printhead to selectively eject ink droplets onto the print media.

Scanners are used to scan a target image and create scanned image data which can be displayed on a computer monitor, which can be used by a computer program, which can be printed, which can be faxed, etc. Scanned data may be saved to memory or a magnetic or optical drive, or other fixed or removable memory device. Scanning devices may be packaged in a stand-alone housing or as part of the all-in-one device, as described herein, including a printing module to perform scanning as well as standard copying functions.

Scanners typically include a housing aperture defined by an edge wherein a platen is located. A target document is positioned on the platen for scanning of the text or image by a scanbar. Depending on the positioning of the scanbar relative to the platen, the platen may be transparent where the scanbar is beneath the platen or may be solid where the scanbar is above the platen. For a typical flatbed scanner, the scanbar will be below the platen, which will have a transparent section to allow for the scan operation.

The scanner may also include an auto-document feeder (ADF) to automatically and sequentially feed a plurality of documents to a scan module. The automatic document feeder typically comprises a feed tray and an input device which feeds a single sheet from the stack of media on the feed tray into the automatic document feeder media path. The single sheet of media passes the reading position where the media is illuminated and image data is created by the scanbar representing images on the media. The media then passes from the auto-document feeder to a stacking tray where the media remains until all of the media from the feed tray has been scanned and is removed from the stacking tray at the output side of the auto-document feeder.

Generally most auto-document feeders are single-side imaging devices. To scan a double-sided image, the media must be turned which is often done manually. Prior art patent have taught various means for reversing media sides and performing double-sided or duplex scanning. According to one method of duplex scanning, the scanning module comprises first and second image sensors to scan first and second sides of the media. However, the problem with these devices is that the two image sensors require large amounts of space and therefore make the equipment footprint much larger. This is not suitable for many applications, such as home, office equipment or small office equipment and further increases the costs of the device which is also undesirable.

While it may be desirable to decrease the footprint of a duplexing auto-document feeder, the shortening the feedpath leads to problems such as overlapping media edges. When media overlaps in a nip, media feed becomes inconsistent leading to decreased scan quality.

Given the foregoing deficiencies, it will be appreciated that an improved apparatus for creating a duplex scan is needed.

SUMMARY OF THE INVENTION

According to a first embodiment, a duplexing auto-document feeder comprises an input tray, a feedpath including a simplex path and a duplex path, the simplex path and the duplex path defining a switchback loop. An image sensor is in an optical communication with the feedpath. An exit system includes an exit shaft and a friction drive system wherein a media leading edge portion and a media trailing edge portion simultaneously pass said exit system in opposite directions. The friction drive comprises a first roller, a second roller and a third roller. The first and the third rollers are disposed against hubs located on the exit shaft. The duplexing auto-document feeder further comprises a first coil spring disposed between the first and second rollers. The duplexing auto-document feeder further comprises a second coil spring disposed between the second and third rollers. The first, second and third rollers rotate with the exit shaft when the exit shaft rotates in a first direction and no media is present. The first, second and third rollers are free to rotate with media when the exit shaft rotates in a second direction.

According to a second embodiment, a duplexing auto-document feeder comprises an input system, a feedpath including an input, a switchback path and an exit system. The switchback path switching a media sheet from a first side to a second side. A friction drive on an exit shaft providing motion of media through the exit system and into the switchback path. The friction drive allows exit roller rotation either with said shaft or with media passing through the exit system adjacent the exit roller. The exit shaft is a reversing shaft. The switchback path has an entry and an exit. A media leading edge and trailing edge simultaneously passing through the exit system. The exit drive roller rotating with the leading edge of the media sheet and an exit idler rotating with the trailing edge of the media sheet.

According to a third embodiment a duplexing auto-document feeder, comprises a media input system and an media exit, a feedpath extending between the input system and the exit. The feedpath has a simplex path and a duplex path forming a switchback loop. The switchback loop is in communication with an exit system. The exit system comprises an exit shaft and at least one roller wherein the at least one roller rotates with said exit shaft or with an adjacent media depending on a direction of rotation of the exit shaft. The exit system including a friction drive system. The at least one roller comprises a first roller, a second roller, and a third roller. The duplexing auto-document feeder further comprises a first hub and a second hub connected to the exit shaft and frictionally engaging the first and third rollers, respectively. The first and third rollers rotate with the shaft or with the adjacent media. The second roller operates as a one-way clutch system by rotating with the exit shaft when the exit shaft rotates in one direction. The second roller rotates with a media passing when the exit shaft rotates in a second direction.

An improved apparatus for duplex scanning using a paper path shorter than the length of paper to be duplexed allows a smaller duplexing ADF footprint, without decreasing scan quality.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
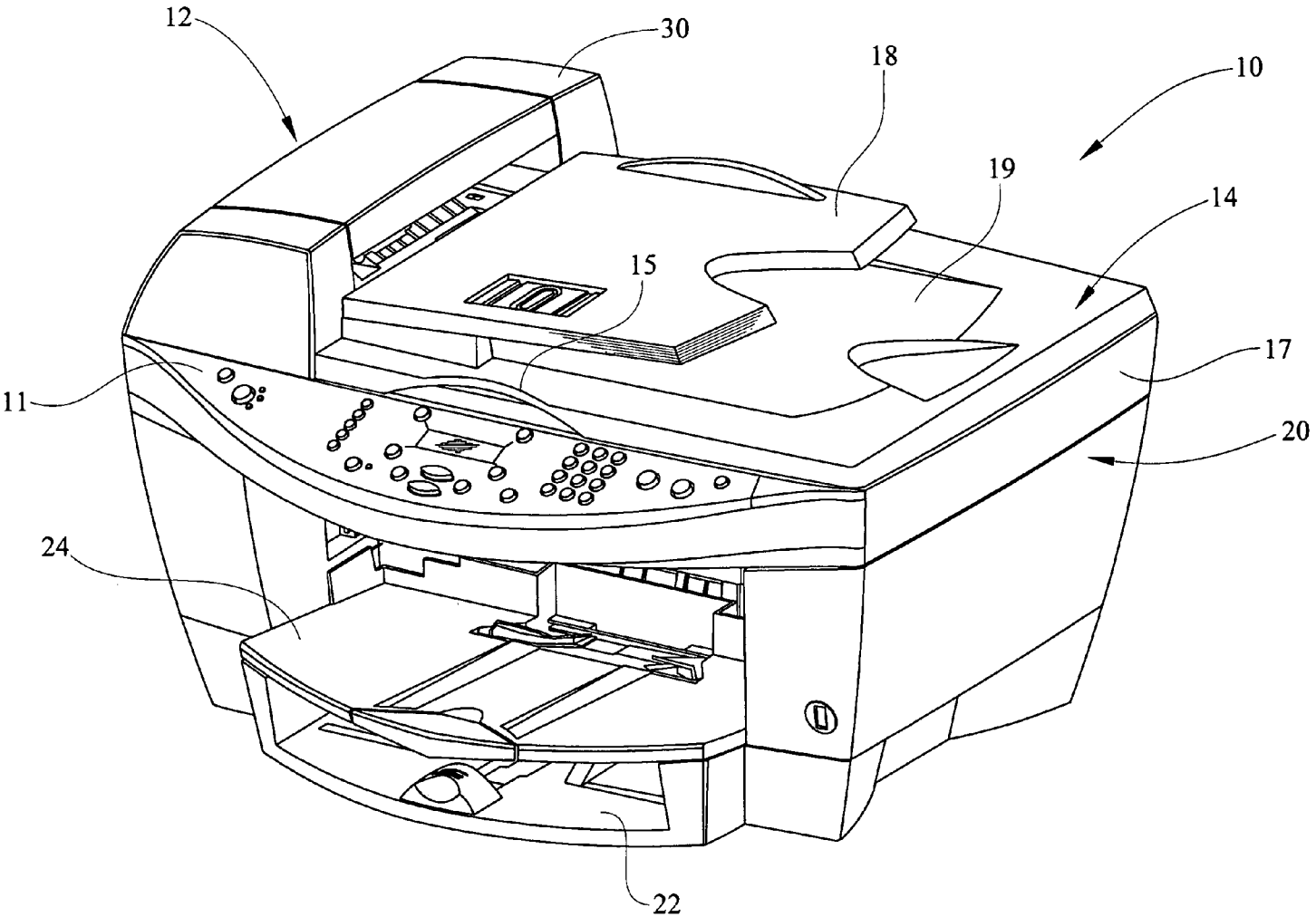
FIG. 1 is a perspective view of an all-in-one device with duplexing auto-document feeder.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that embodiments of the invention include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible.

The term image as used herein encompasses any printed or digital form of text, graphic, or combination thereof. The term output as used herein encompasses output from any printing device such as color and black-and-white copiers, color and black-and-white printers, and so-called "all-in-one devices" that incorporate multiple functions such as scanning, copying, and printing capabilities in one device. Such printing devices may utilize ink jet, dot matrix, dye sublimation, laser, and any other suitable print formats. The term button as used herein means any component, whether a physical component or graphic user interface icon, that is engaged to initiate output.

Referring now in detail to the drawings, wherein like numerals indicate like elements throughout the several views, there are shown in FIGS. 1-12 various aspects of a duplexing ADF using a paperpath shorter than the length of paper to be duplexed. The apparatus provides various functions including minimizing cost and size of the duplexing auto-document feeder. The present invention allows duplex scanning using a switchback or recirculation path wherein a media leading edge and a trailing edge pass through an exit system simultaneously without decreasing scan quality or inhibiting media feeding. The device provides an exit system with a friction drive roller system allowing the rollers to rotate either with the shaft or with media passing adjacent the roller depending on rotation of the exit shaft.

Referring initially to FIG. 1, an all-in-one device 10 is shown having an auto-document feeding scanner portion 12 and a printer portion, generally defined by a housing 20. The all-in-one device 10 is shown and described herein, however one of ordinary skill in the art will understand upon reading of the instant specification that the present invention may be utilized with a stand alone printer, copier, auto-document feed scanner, or other device utilizing a media feed system. The peripheral device 10 further comprises a control panel 11 having a plurality of buttons for making selections. The control panel 11 may include a graphics display to provide a user with menus, choices or errors occurring with the system.

Still referring to FIG. 1, extending from the printer portion 20 are an input tray 22 and an exit tray 24 disposed above the input tray 22. The printer portion 20 may include various types of printing mechanisms including a laser printing mechanism or an inkjet printing mechanism. These are known in the prior art and therefore will not be described herein.

Referring still to FIG. 1, the scanner portion 12 generally includes an auto-document feeder 30, a scanner bed 17 and a lid 14 which is hingedly connected to the scanner bed 17. Beneath the lid 14 and within the scanner bed 17 may be a transparent platen for placement and support of target or original documents for manually scanning. Along a front edge of the lid 14 is a handle 15 for opening of the lid 14 and placement of the target document on the transparent platen (not shown). Adjacent the lid 14 is an exemplary duplexing auto-document feeder 30 which automatically feeds and scans stacks of documents which are normally sized, e.g. letter, legal, or A4, and suited for automatic feeding. Above the lid 14 and adjacent an opening in the auto-document feeder 30 is an auto-document feeder input tray 18 which supports a stack of target media or documents for feeding through the auto-document feeder 30. Beneath the input tray 18, the upper surface of the lid 14 also functions as an output tray 19 for receiving documents fed through the auto-document feeder 30 and scanned by the scanner portion 12.

Beneath the auto-document feeder 30 is an optical scanning unit having a plurality of parts which are not shown but generally described herein. The scanning unit may comprise a scanning motor and drive which connects the scanning motor and a scanbar 16, shown generally in FIG. 4. The scanbar 16 is driven bi-directionally along a scanning axis extending in the direction of the longer dimension of a scanner bed. At least one guide bar may be disposed within the scanner bed 17 and may extend in the direction of the scanning axis to guide the scanning bar 16 along the scanning axis. The scanbar 16 moves along the at least one guide bar within the scanner bed 17 beneath the platen. The scanbar 16 has a length which extends in the shorter dimension of the scanning bed. Thus, the scanbar 16 extends across one dimension and moves in a perpendicular dimension to scan an entire surface area of the platen during flatbed scanning.

The scanbar 16 may include a lamp, an image sensor, and a mirror therein for obtaining a scanned image from a document. The image sensor may be an optical reduction type image sensor or a contact image sensor (CIS) as is known in the art. In either event, the image sensor then determines the image and sends data representing the image to onboard memory, a network drive, or a PC or server housing, a hard disk drive or an optical disk drive such as a CD-R, CD-RW, or DVD-R/RW. Alternatively, the original document may be scanned by the optical scanning component and a copy printed from the printer portion 20 in the case of a multi-function peripheral device 10. The scanbar 16 is generally either an optical reduction type using a combination of lens, mirror and a CCD (Charge Coupled Device) array or CIS array. The CCD array is a collection of tiny, light-sensitive diodes, which convert photons into electrons. These diodes are called photosites—the brighter the light that hits a single photosite, the greater the electrical charge that will accumulate at that site. The image of the document that is scanned using a light source such as a fluorescent bulb reaches the CCD array through a series of mirrors, filters and lenses. The exact configuration of these components will depend on the model of scanner. Some optical reduction scanners use a three pass scanning method. Each pass uses a different color filter (red, green or blue) between the lens and CCD array. After the three passes are completed, the scanner software assembles the three filtered images into a single full-color image. Most optical reduction scanners use the single pass method. The lens splits the image into three smaller versions of the original. Each smaller version passes through a color filter (either red, green or blue) onto a discrete section of the CCD array. The scanner software combines the data from the three parts of the CCD array into a single full-color image.

In general, for inexpensive flatbed scanners CIS arrays are used in the scanbar. CIS arrays replace the CCD array, mirrors, filters, lamp and lens with an array of red, green and blue light emitting diodes (LEDs) and a corresponding array of phototransistors. The image sensor array consisting of 600, 1200, 2400 or 4800 LEDs and phototransistors per inch (depending on resolution) spans the width of the scan area and is placed very close to the glass plate upon which rest the image to be scanned. Another version of the CIS used a single set of red, green and blue LEDS in combination with light pipes to provide illumination of the material to be scanned. When the image is scanned, the LEDs combine to provide a white light source. The illuminated image is then captured by the row of sensors. CIS scanners are cheaper, lighter and thinner, but may not provide the same level of quality and resolution found in most optical reduction scanners. Color scanning is done by illuminating each color type of LED separately and then combining the three scans.

Figure 2:
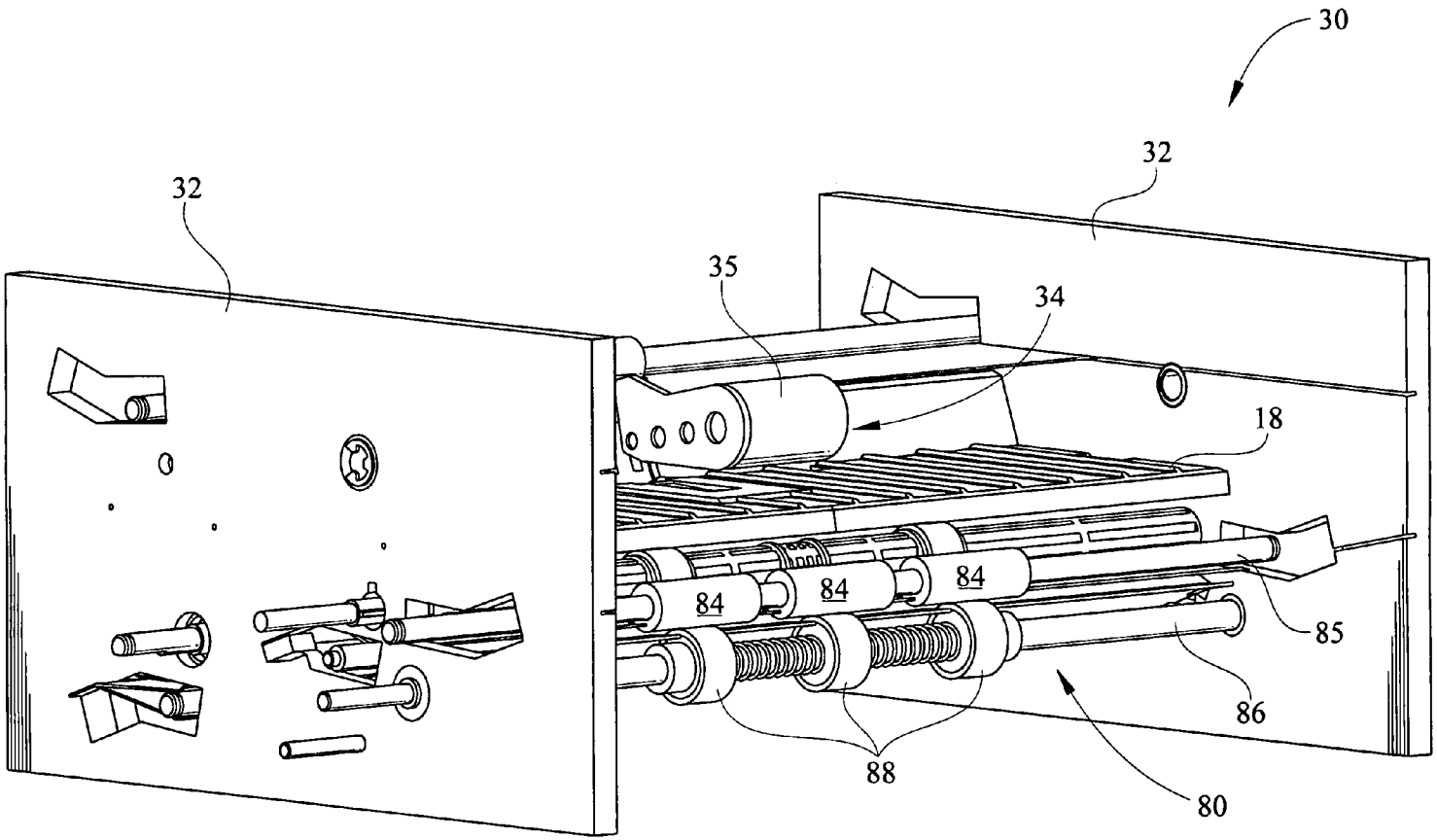
FIG. 2 is a perspective view of the duplexing auto-document feeder of FIG. 1 with the cover set removed.
Figure 3:
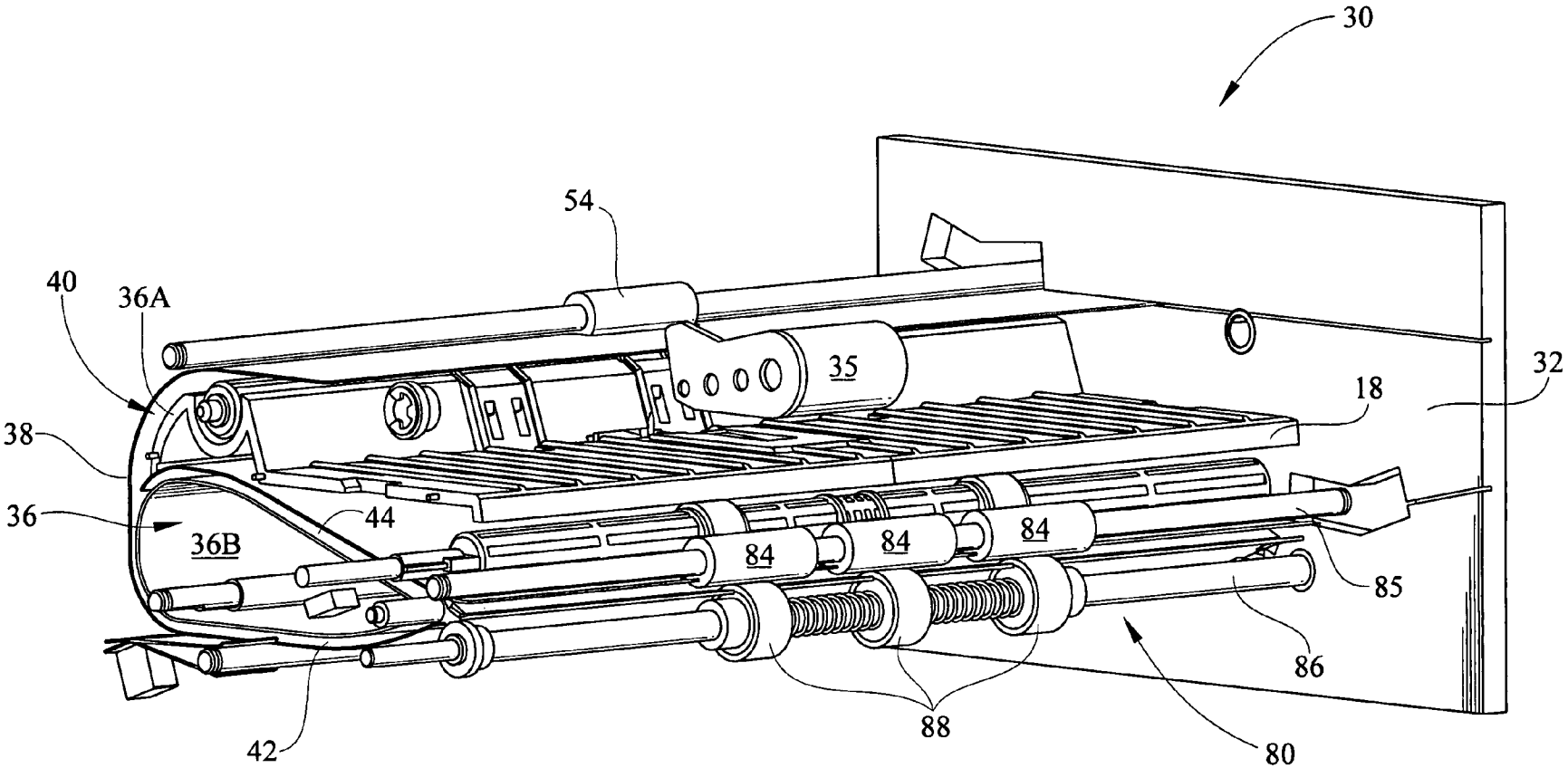
FIG. 3 is a perspective view of FIG. 2 with side frame removed.

Referring now to FIGS. 2-3, perspective views are shown of the internal components defining the duplexing auto-document feeder 30 with the cover set removed. The auto-document feeder 30 comprises first and second side frames 32 and a plurality of shafts and structures extending between the side frames 32. The auto-document feeder 30 comprises a feedpath 40 extending between the input tray 18 and the exit system 80. The exit system 80 comprises an exit shaft 86 having a plurality of exit shaft rollers 88 mounted thereon and an opposed idler shaft 85 having a plurality of idler rollers 84 which engage the exit shaft rollers 88. The feedpath 40 therefore extends between the input tray 18 and the exit system 80.

The auto-document feeder 30 further comprises a pick system 34 disposed substantially above the input tray 18 having an auto-compensating mechanism 35 feeding media to the ADF 30. The auto-compensating mechanism 35 comprises an internal gear train (not shown) and pick tire 37 (FIG. 4) which engages the uppermost media sheet of the media stack on the input tray 18. The auto-compensating mechanism 35 picks an uppermost media sheet from a media stack supported on the input tray 18 and moves the uppermost sheet into the feedpath for scanning. The auto-compensating mechanism 35 is known to one of ordinary skill in the art and therefore will not be described in detail. Further, one of ordinary skill in the art will recognize that alternative pick mechanisms may be utilized with the instant invention.

Figure 4:
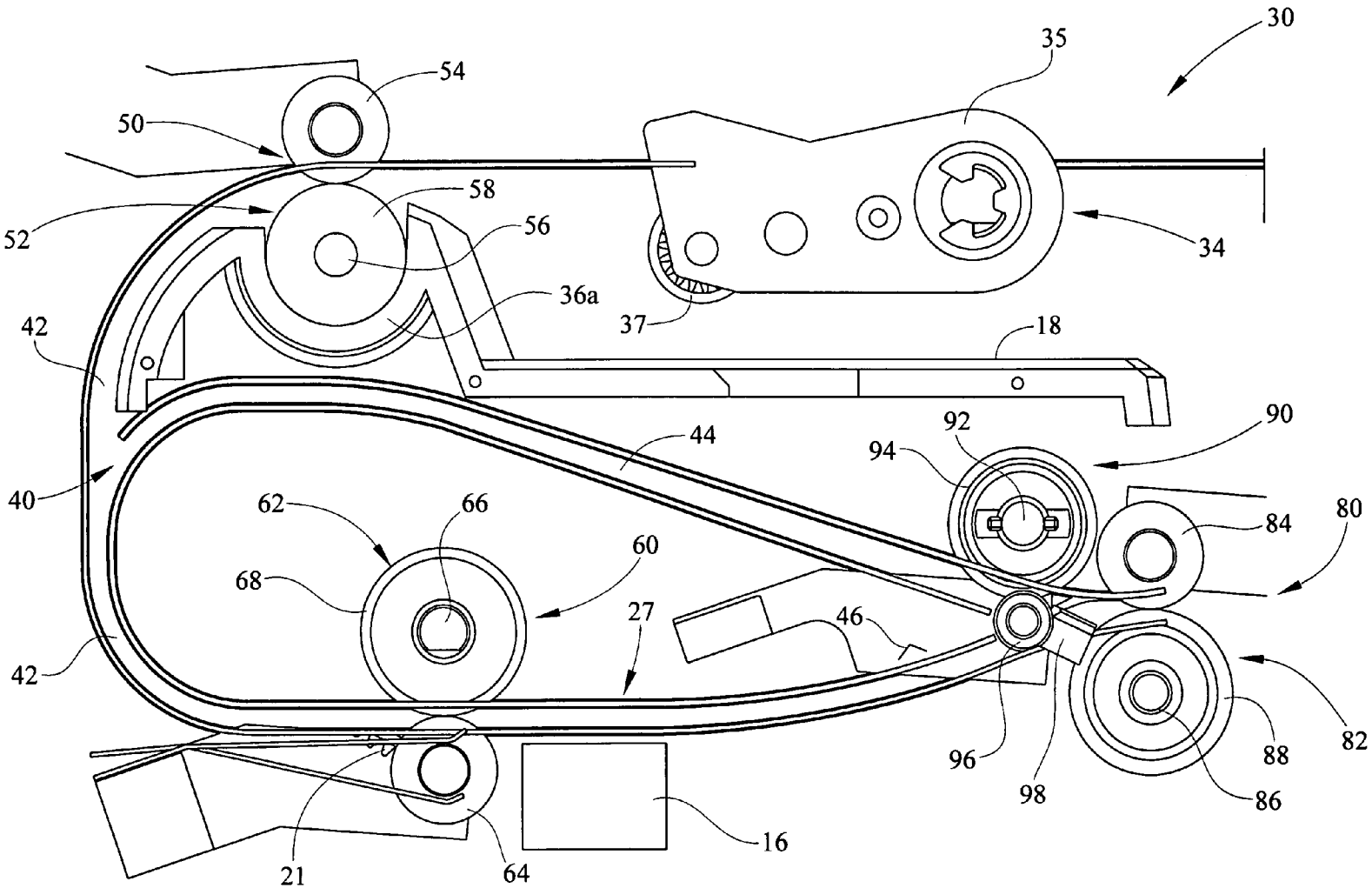
FIG. 4 is a side view of the duplexing auto-document feeder.

As shown in FIG. 3, one of the side frames 32 is removed revealing an inner frame 36 and an outer frame 38. The inner frame 36 is defined by an upper inner frame **36*a* and a lower inner frame 36*b*. The upper inner frame 36*a* extends from an inward portion of the input tray 18. The lower inner frame 36*b* is substantially oblong in shape and is disposed beneath the upper inner frame 36*a*. Along the upper surface of the lower inner frame 36*b* and the lower surface of the upper inner frame 36*a* is a duplex path 44. The outer frame 38 is substantially C-shaped and surrounds the upper inner frame 36*a* and lower inner frame 36*b* to further define a feedpath 40. The feedpath 40 generally extends between the input tray 18 and the exit system 80. The feedpath 40 is defined by a simplex path 42 and a duplex path 44. The path created between the upper inner frame 36*a* and outer frame 38 defines an upper portion of the simplex path 42. The lower portion of the simplex path 42 is defined between the left and lower surfaces of the lower inner frame 36*b* and outer frame 38. The simplex path 42 is substantially C-shaped, however various shapes may be utilized. The duplex path 44 and lower portion of the simplex path 42 form a switchback path or loop for changing the media side exposed to the scanbar 16 (FIG. 4). The switchback path is substantially oblong having a common starting and finish position near the exit system 80**.

Referring now to FIG. 4, a side view of the auto-document feeder 30 is depicted including various portions of the feedpath 40 as well. The pick system 34 is shown disposed above the input tray 18. As previously indicated, the pick system moves an uppermost media sheet from a media stack into the feedpath 40. Near the entrance portion of the feedpath 40 is a delivery system 50 which receives media moved by the pick or input system 34. The delivery system 50 comprises a delivery drive 52 and at least one delivery idler roller 54. The delivery drive 52 includes a delivery shaft 56 and at least one delivery drive roller 58. The at least one delivery drive roller 58 is connected to the shaft 56 and therefore rotates with the shaft 56. The delivery drive 52 is driven by a gear train 21, which is located on one of the side frames 32 (FIG. 2) and a motor (not shown) located on a motor plate. The motor and gear train 21 cause rotation of various driven rollers described herein. The delivery idler 54 includes at least one roller that rotates freely on an idler shaft. The delivery idler rollers 54 are biased toward the at least one delivery drive roller 58 by a biasing member, such as a leaf spring to form a nip between the delivery drive 52 and the delivery idler 54. The delivery system 50 receives media picked by the auto-compensating mechanism 35 and feeds the media through the feedpath 40 to a feed system 60. The upper inner frame 36*a* has a substantially U-shaped portion to receive the delivery drive 52.

The feed system 60 comprises a feed drive 62 and an opposed feed idler roller 64. The feed drive 62 comprises a shaft 66 and at least one roller 68 connected to the shaft for rotation therewith. The feed idler roller 64 is biased toward the feed drive 62 defining a nip which receives media from the delivery system 50 and directs the media across a scanning station 27 and onto the exit system 80. The feed idler roller 64 is biased by a biasing member such as a leaf spring or other such member to define a nip between the feed roll 68 and feed idler roll 64.

Between the feed system 60 and the exit system 80 is a scanning station generally represented by a scanbar 16. As previously discussed, media M passing through the feedpath 40 is exposed to light in order to acquire image data of the image or text on the media.

Within the feedpath 40 just upstream of the exit system 80 is a gravity gate 98. The gravity gate 98 is pivotally connected to the side frames 32 and is normally disposed in a downward position. The gravity gate 98 may be pivoted upwardly providing access to the exit system 80 from the feedpath path 40. When a media sheet trailing edge passes the gate 98 and is disposed in the exit system 80, access is provided to the duplex path 44.

The duplex feed system 90 is located on the duplex path 44 adjacent the exit system 80. The duplex feed system 90 comprises a duplex shaft 92 and at least one duplex feed roll 94 connected to the shaft 92. Adjacent the at least one duplex feed roll 94 is a duplex idler 96 which is biased toward the at least one duplex feed roll 94 and defines a nip with the feed rolls 94. The duplex feed system 90 receives media M from the exit system 80 and directs media along the duplexing path 44 to the feed system 60 wherein a second side of the media is scanned before exiting the auto-document feeder 30 through the exit system 80.

Referring still to FIG. 4, the exit system 80 is depicted comprising an exit drive 82 and exit idler 84. The exit drive 82 comprises an exit drive shaft 86 and a plurality of exit drive rolls 88. The exit idler 84 is biased toward the exit drive 82 by a biasing member to define a nip which receives media from the feed system 60.

Figure 5:
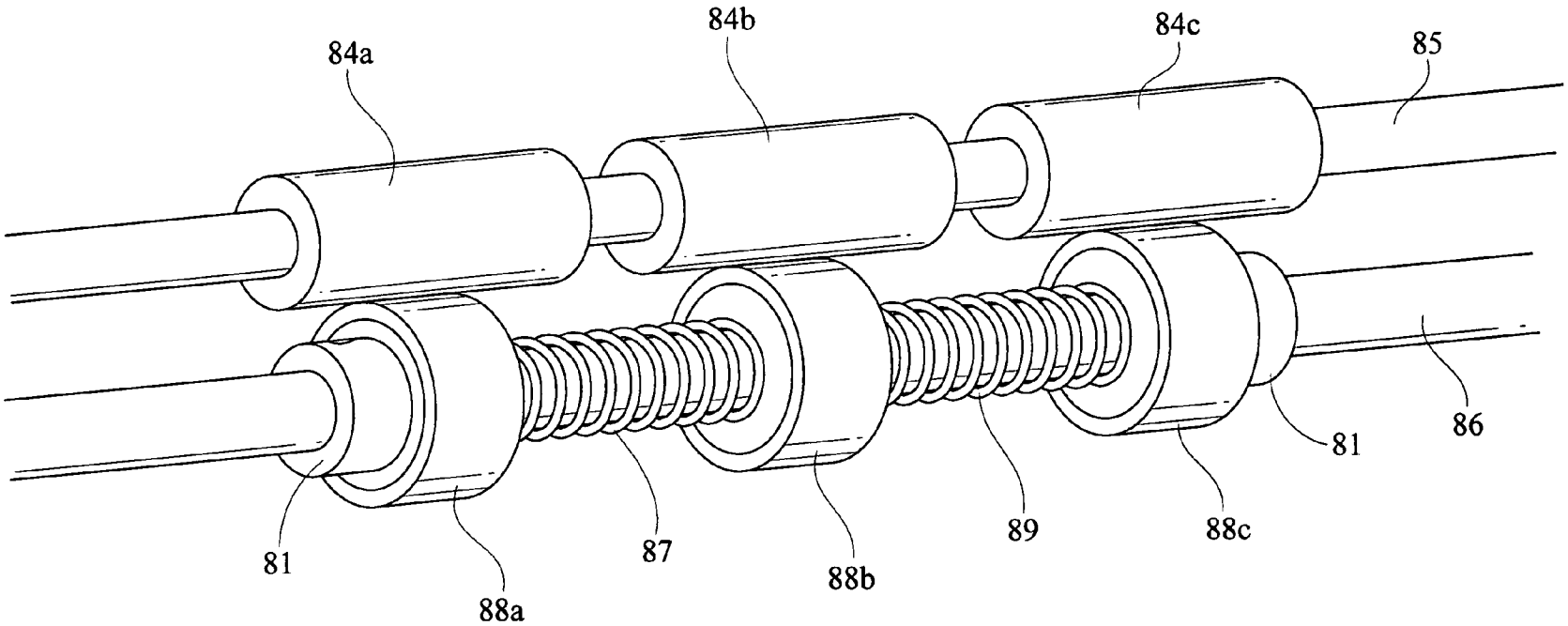
FIG. 5 is a perspective view of the exit system of the present invention.
Figure 6:
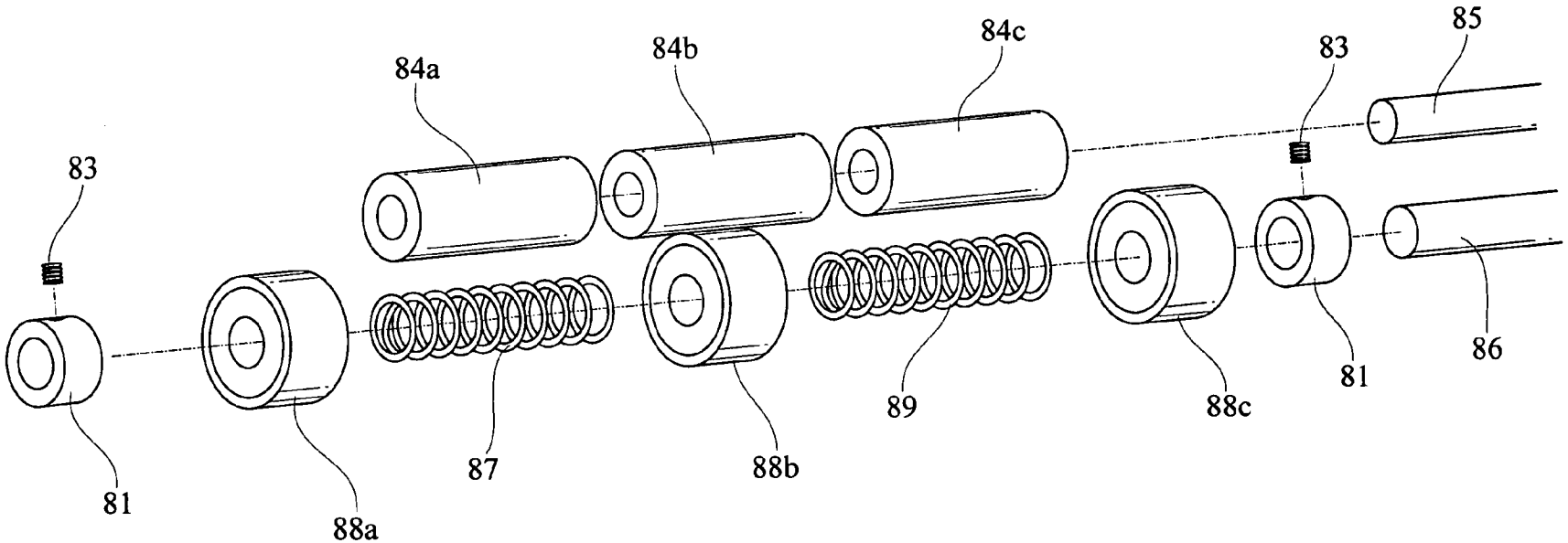
FIG. 6 is an exploded perspective view of the exit system of FIG. 5.

More specifically referring to FIGS. 5-6 the exit system 80 is shown in perspective views. An idler shaft 85 includes a first idler roller 84*a*, a second idler roller 84*b* and a third idler roller 84*c* rotatably connected to the idler shaft 85 for rotation thereon. The idler shaft 85 and idler rollers (collectively 84) are biased toward the exit shaft 86 and exit rollers 88 by a biasing member. The exit shaft 86 includes a first exit roller 88*a*, a second exit roller 88*b* and a third exit roller 88*c*. On the exit shaft 86, hubs 81 are fixedly connected for example by a set screw 83 or other fixing mechanism so that as the shaft 86 rotates, the hubs 81 also rotate. The first exit roller 88*a* and the third exit roller 88*c* are each freely rotatable on the shaft 86. Disposed between the first exit roller 88*a* and the second exit roller 88*b* is a coil spring 87. Likewise, disposed between the second exit roller 88*b* and the third exit roller 88*c* is a second coil spring 89. With the coil springs 87, 89 formed of a pre-selected length and the hubs 81 disposed at pre-selected positions, the first and second coil springs 87, 89 are compressed respectively between the sides of the first and third exit roll 88*a*, 88*c* and the opposite sides of the second exit roller 88*b*. The coil springs 87, 89 provide an axial force on the first exit roller 88*a* and the third exit roller 88*c* causing friction between the hubs 81 and each of the rollers 88*a*, 88*c*. The hubs 81 are axially positioned along the exit shaft 86 to initially compress the springs 87, 89 and provide a pre-selected amount of force on the first, second and third exit rollers (collectively 88). By moving hubs 81 axially along the shaft 86 the compression force may be varied. The second exit roller 88*b* receives force from the spring 87 and the spring 89 and therefore receives twice the force that is placed on each of the first exit roller 88*a* and the third exit roller 88*c*. The force may be varied by adjusting the position of the hub 81, thus lengthening or shortening the compressed spring. This arrangement provides a friction drive system.

The friction drive functions such that when the exit shaft 86 rotates in a direction $S_1$ (FIG. 9), the second roller 88*b* rotates with the exit shaft 86. When the exit shaft 86 rotates in a direction $S_2$ (FIG. 10), the second roller 88*b* acts as a friction drive with the first and third exit rollers 88*a*, 88*c*. The first and third exit rollers 88*a*, 88*c* always operate in a friction drive arrangement. The rollers 88*a*, 88*b*, 88*c* rotate with the shaft 86 when no media is present in the nip defined between the exit rollers (collectively 88) and the idler rollers (collectively 84). However, when media is present in the nip the exit rollers (collectively 88) rotate with the direction of the media moving against those rollers. Thus, when exit shaft 86 rotates in the direction $S_2$ the exit shaft rollers (collectively 88) rotates in the path of least resistance and greatest driving force.

Figure 7:
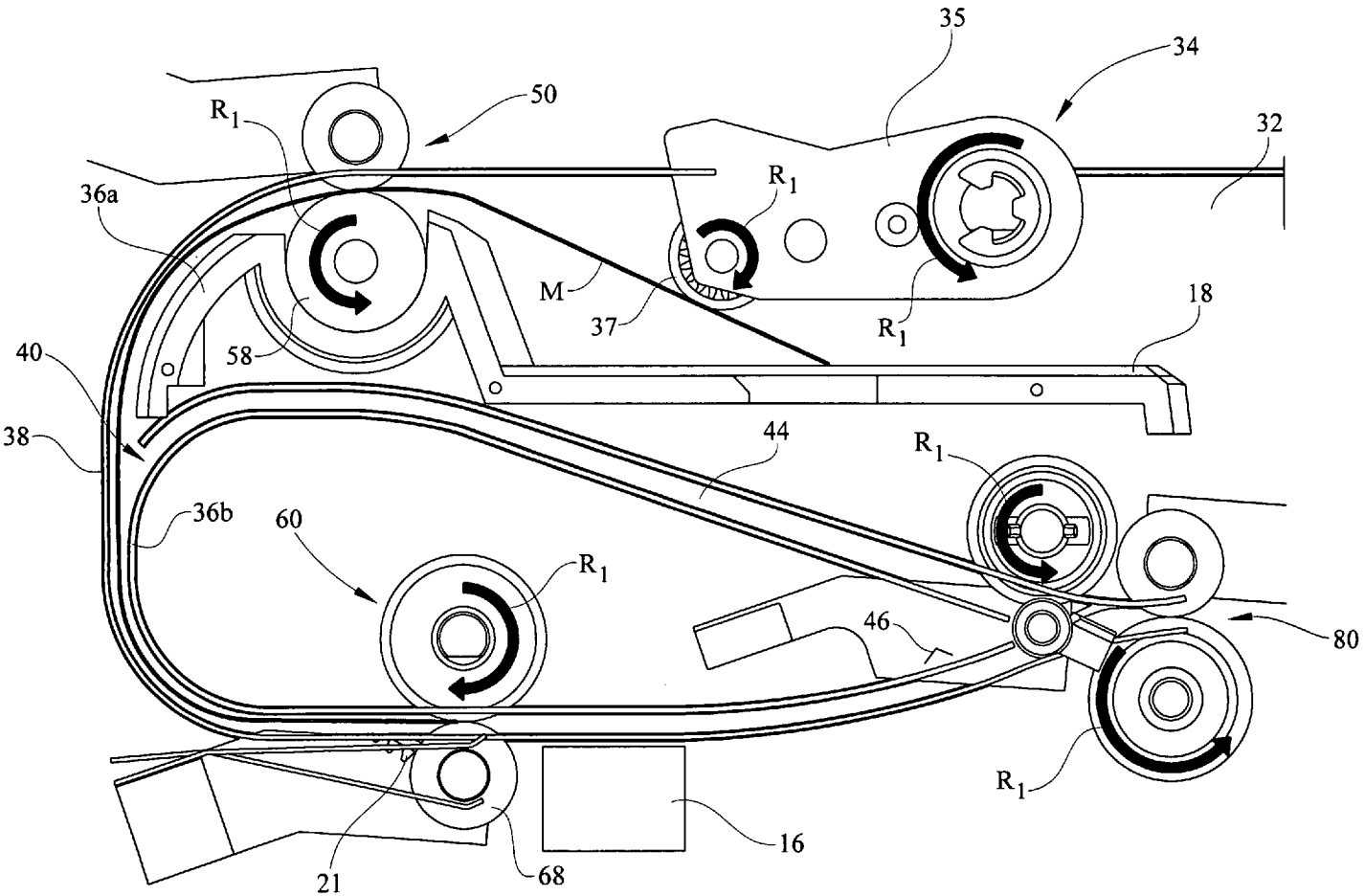
FIG. 7 is a side sequence view of a pick process.

Referring now to FIGS. 7-12, a sequence of views depicting the media M being directed through the auto-document feeder 30 is shown. The pick system 34 is depicted directing the media M first side up into the feedpath 40. Specifically, the media M is directed into the nip at the delivery system 50 and further directed toward the feed system 60. Circular arrows are shown on the pick system 34, the delivery system 50, the feed system 60, the exit system 80 and the duplex feed roll 90. In FIG. 7 each arrow is labeled $R_1$ representing a first direction of rotation. The first rotational direction $R_1$, is caused by the motor disposed on the motor plate and the gear train 21 located along one of the side frames 32. The first rotational direction $R_1$ feeds the media M into the auto-document feeder 30 from the feed tray 18 through the delivery system 50 toward the feed system 60. The delivery drive roll 58 is designed to rotate at a faster speed than the pick tire 37 of the pick system 34. This avoids the possibility of a double or multiple media sheet pick. As the leading edge of the media M reaches the feed system 60, the feed drive roller 68 is rotating in a direction that is opposite to the feed direction of the media M through the feedpath 40. This rotation of the feed roller 68 provides registration and alignment of the media sheet M before further advancing toward the scanbar 16 and exit system 80.

Figure 8:
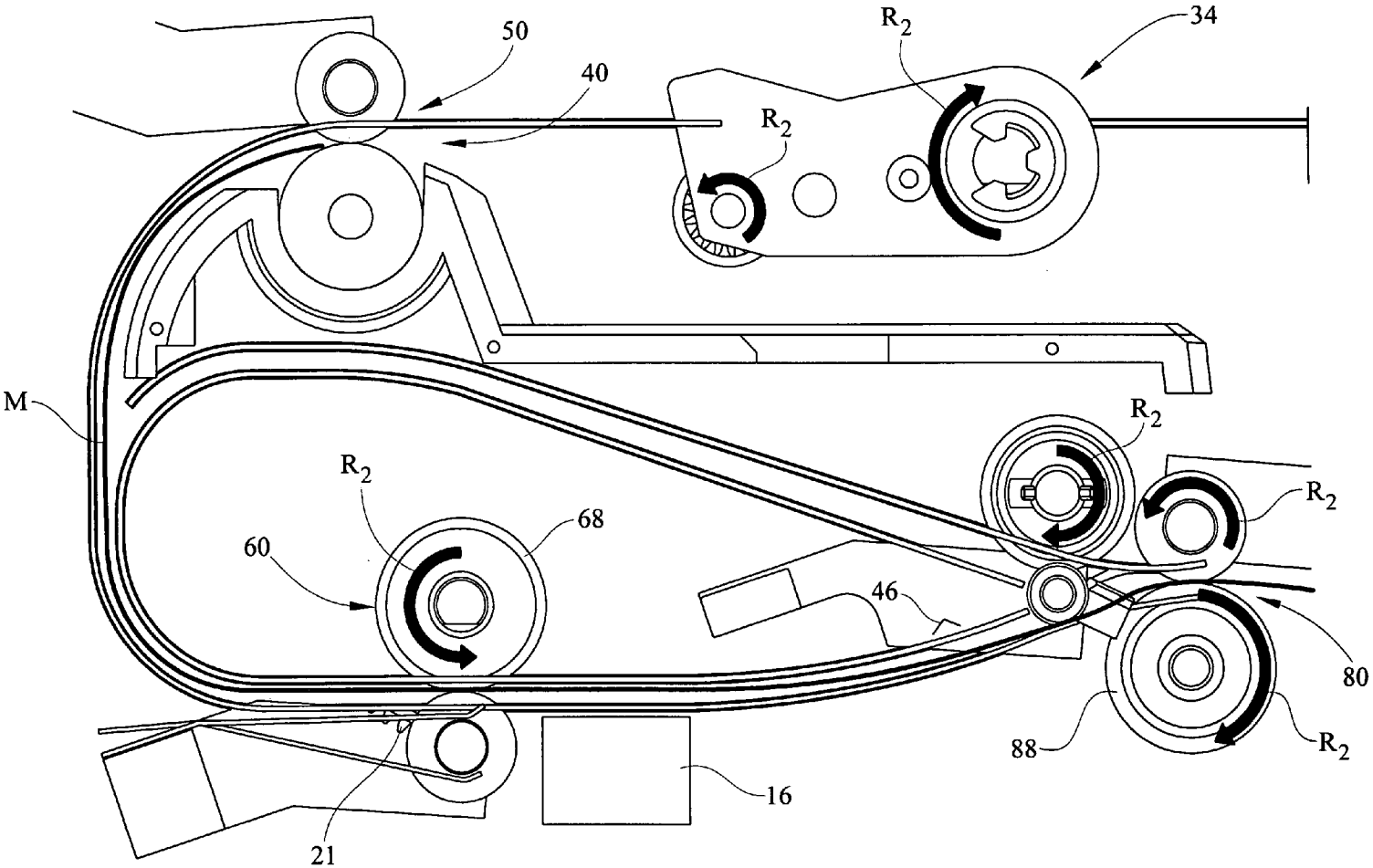
FIG. 8 is a side sequence view of a feed process.

Referring now to FIG. 8, the pick system 34, the feed system 60, the exit system 80 and the duplex feed system 90 are all shown rotating in a second direction, labeled $R_2$ following the deskew of the media leading edge at feed system 60 previously described. In direction $R_2$, the auto-compensating mechanism 35 is lifted from the top of the input media stack. This mechanism will be understood by one of ordinary skill in the art and will not be discussed for purpose of clarity. As depicted, the trailing edge of the media M is moved past the delivery system 50. Since the motor and gear train 21 have been changed to the second direction, the driven rollers are shown rotating in direction $R_2$ and the media handling is performed at the feed system 60. The delivery system 50 may not be driven in direction $R_2$ since it is not handling media, however, it is well within the scope of the present invention that the delivery system 50 could be driven once media passes that portion of the feedpath 40. Specifically, the feed roller 68 directs media past the scanbar 16 with the first side down toward the exit system 80 and past a sensor 46. Accordingly, the media is shown with the leading edge extending through the nip defined in the exit system 80 and partially beyond to an exit tray 19 (FIG. 1). FIGS. 7 and 8 are representative of the media movement and operation necessary to perform a simplex scan. However, these operations occur whether a user selects a simplex scan or a duplex scan.

Figure 9:
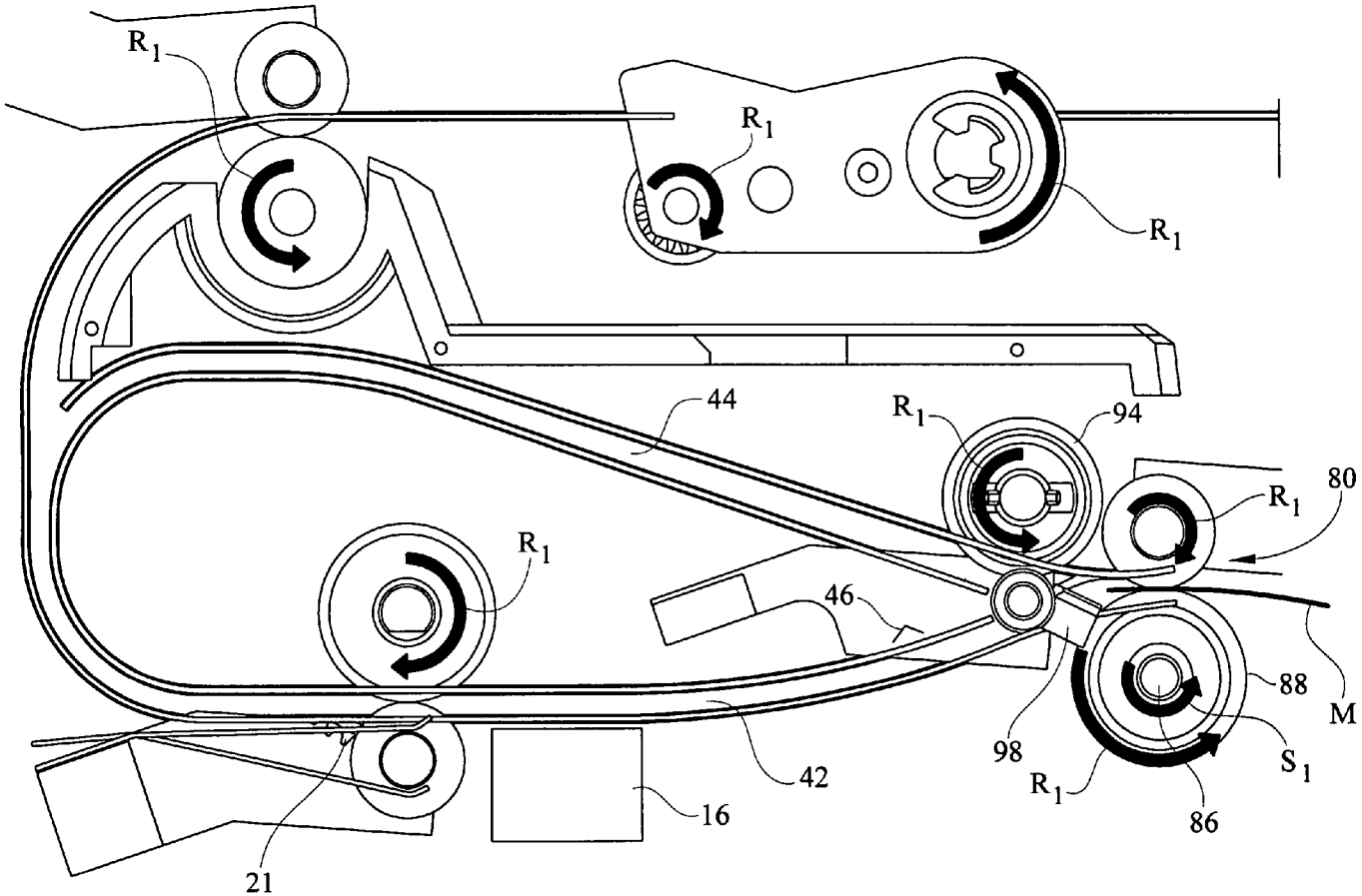
FIGS. 9-12 are a sequence view of a duplex scanning process.

Referring now to FIG. 9, once the trailing edge of media M passes the sensor 46, the media M advances through the feedpath a pre-selected known number of steps to the exit system 80. At the end of the simplex scan, the media trailing edge passes the gate 98 and is disposed within the exit system 80 while portions of the media M between the leading and trailing edges extend outwardly from the exit system 80. From this position, the media M is fully advanced to the exit tray 19 first side down if the simplex function is selected.

Alternatively, the user may have selected a duplex scan function either on the control panel 11 (FIG. 1) or via software providing selection capability on a computer monitor connected to the all-in-one device 10 (FIG. 1). If the duplex function is selected, the media M is directed through the duplex path 44 and around the switchback path to scan the second side at the scanbar 16 during the duplex scan. Since the gate 98 is a gravity gate, the simplex path 42 is blocked such that the media M must move toward the counter-rotating duplexing feed roll 94. In order to direct the media M to the duplex path 44, the motor is again reversed thereby reversing the rotational direction of the exit system 80 to $R_1$ Specifically, the exit shaft 86 rotates in direction $S_1$ wherein the rollers (collectively 88) rotate with the exit shaft 86. When this occurs, the media leading edge, formerly the trailing edge, is directed first side down toward the duplex path 44 and toward the duplex feed roll 94, depicted rotating opposite to the feeding direction caused by the exit system 80. Since the duplex feed roll 94 is rotating opposite to the direction of feeding through the duplex path 44, when the media M engages the duplex feed roll 94 the media M is deskewed. The small feed distance of $R_1$ into the duplex feed roll 94 is not enough distance to initiate a second pick from the input tray.

Figure 10:
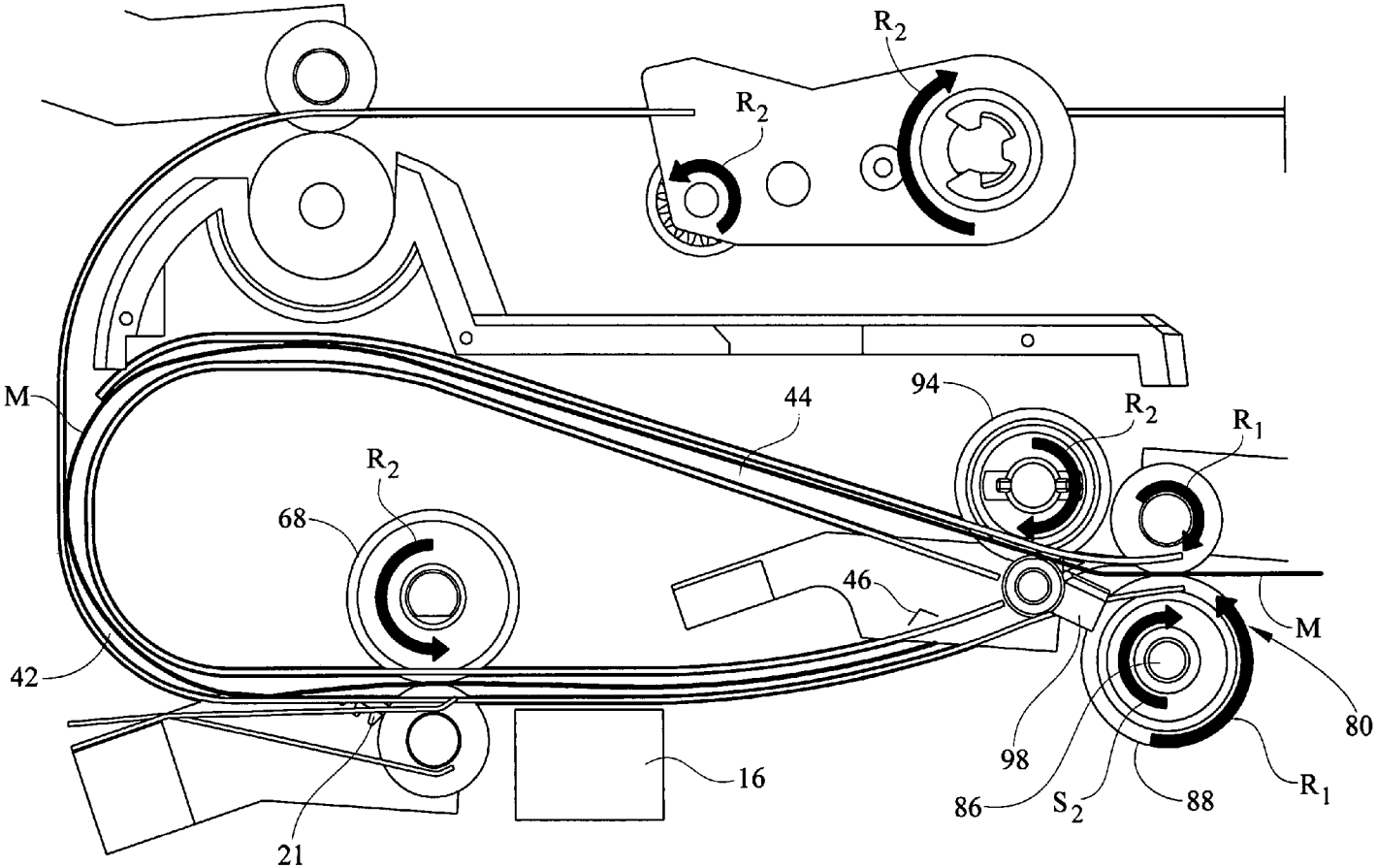

Referring now to FIG. 10, the feedpath driving rolls are reversed to the direction $R_2$ wherein the media M is moving through the switchback loop defined by the duplex path 44 and the lower simplex path portion 42. The media M is directed from the duplex feed roll 94 around the switchback loop to the feed roll 68. Movement about the switchback loop causes the media to change from a first side down orientation to a second side down orientation. The feed roll 68 is rotated in the direction $R_2$, further directing the media M past the scanbar 16 second side down toward the exit system 80. Since the media is directed through the switchback path, the second side of the media M is exposed to the scanbar 16 in order to obtain duplex scan data.

The exit system 80 is depicted directing the trailing edge of the media M to the duplexing feed roller 94 and through the switchback path. The leading edge of the media M is shown passing the scanbar 16, the sensor 46 and moving toward the exit system 80. As shown the exit shaft 86 is rotating in a clockwise direction labeled $S_2$ which corresponds to the rotation $R_2$ shown throughout the feed path 40. As previously indicated, when the shaft 86 is rotating in the direction $S_2$ the rollers 88 either rotate with the shaft 86 when no media is present or with the direction of media movement. Accordingly, since the trailing edge of media M is moving from the exit system 80 into the duplex path 44, the rollers 88 have a rotation $R_1$ corresponding to the movement of the media. One of ordinary skill in the art will recognize that the shaft 86 is rotating in the direction $S_2$ while the rollers 88 are rotating in an opposite direction with the media. Such operation is allowed by the friction drive arrangement previously described herein. As the media M is moved through the feedpath 40 by the duplex feed roller 94 and feed roller 68, the frictional engagement of the media M and exit rollers 88 overcome the opposite force of the exit springs 87,89. Thus, the rollers 88 rotate with the moving media rather than the exit shaft 86.

Figure 11:
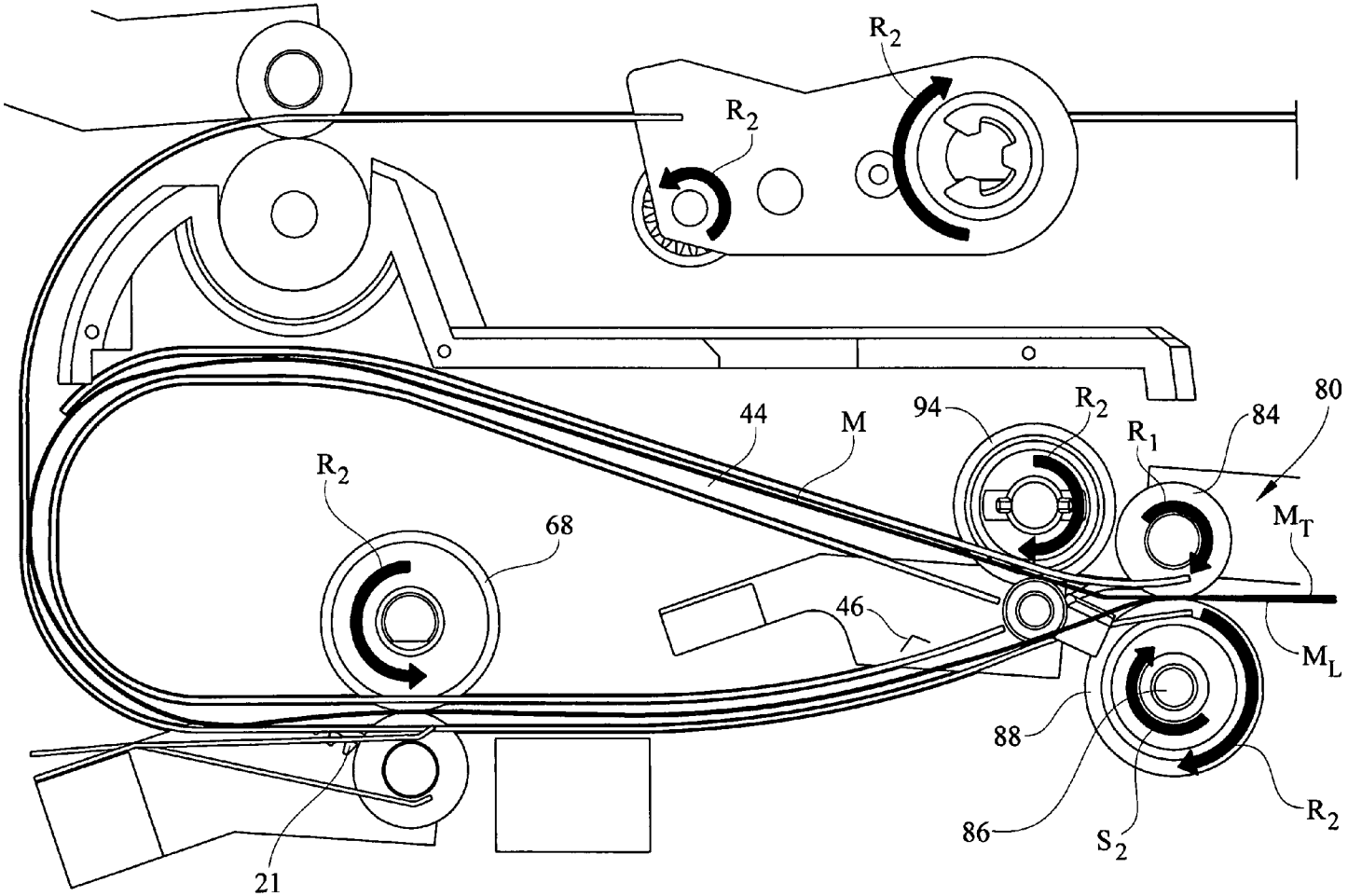

Referring now to FIG. 11, the media is shown extending from the exit system 80 through the switchback path through the exit system 80. Specifically, the trailing edge of the media $M_T$ is passing through the exit system 80 and the leading edge of the media $M_L$ is also extending from the exit system 80 so that the media is sliding against itself as it passes through the exit system 80 and extends around the entire switchback path. As previously indicated such movement may cause media skew and scanning defects in prior art devices. However, the instant friction drive or friction clutch design overcomes such deficiencies. In the instant friction clutch design, the rollers 88 are driven until a certain amount of force overcomes the force of the biasing members 87,89. At that time, the rollers 88 stop rotating with the shaft 86 and instead rotate with the larger force acting on rollers 88. In the present embodiment, such force is provided by the leading edge of the media $M_L$. The duplex feeding roller 94 and the exit idler rolls 84 are rotating in the direction of the media trailing edge $M_T$ moving into the feedpath 40. The rotation of the exit idler rolls 84 is $R_1$. The shaft 86 is depicted rotating in a direction labeled $S_2$ which corresponds to the direction $R_2$ of the duplex feed roller 94 and the feed roller 68. With the exit shaft 86 rotating in a direction $S_2$, the exit rollers 88 rotate with the media engaging it. As depicted, the leading edge of the media $M_L$ is moving past the rollers 88 causing the rotation in the direction $R_2$ in the same direction as the exit shaft $S_2$.

According to an alternative embodiment, the friction drive system may be substituted with a one-way clutch or drive system. Whereas the friction clutch typically drives to a certain point and then slips, the one-way clutch drives in a single direction and slips in the opposite direction. Thus the friction system embodiment could be substituted for a one-way clutch system which allows rollers 88 to slip when the exit shaft 86 rotates in one direction but rotate with the shaft 86 in the opposite direction. The rotational arrows for the exit system 80 would not change for operation of such alternative embodiment.

Figure 12:
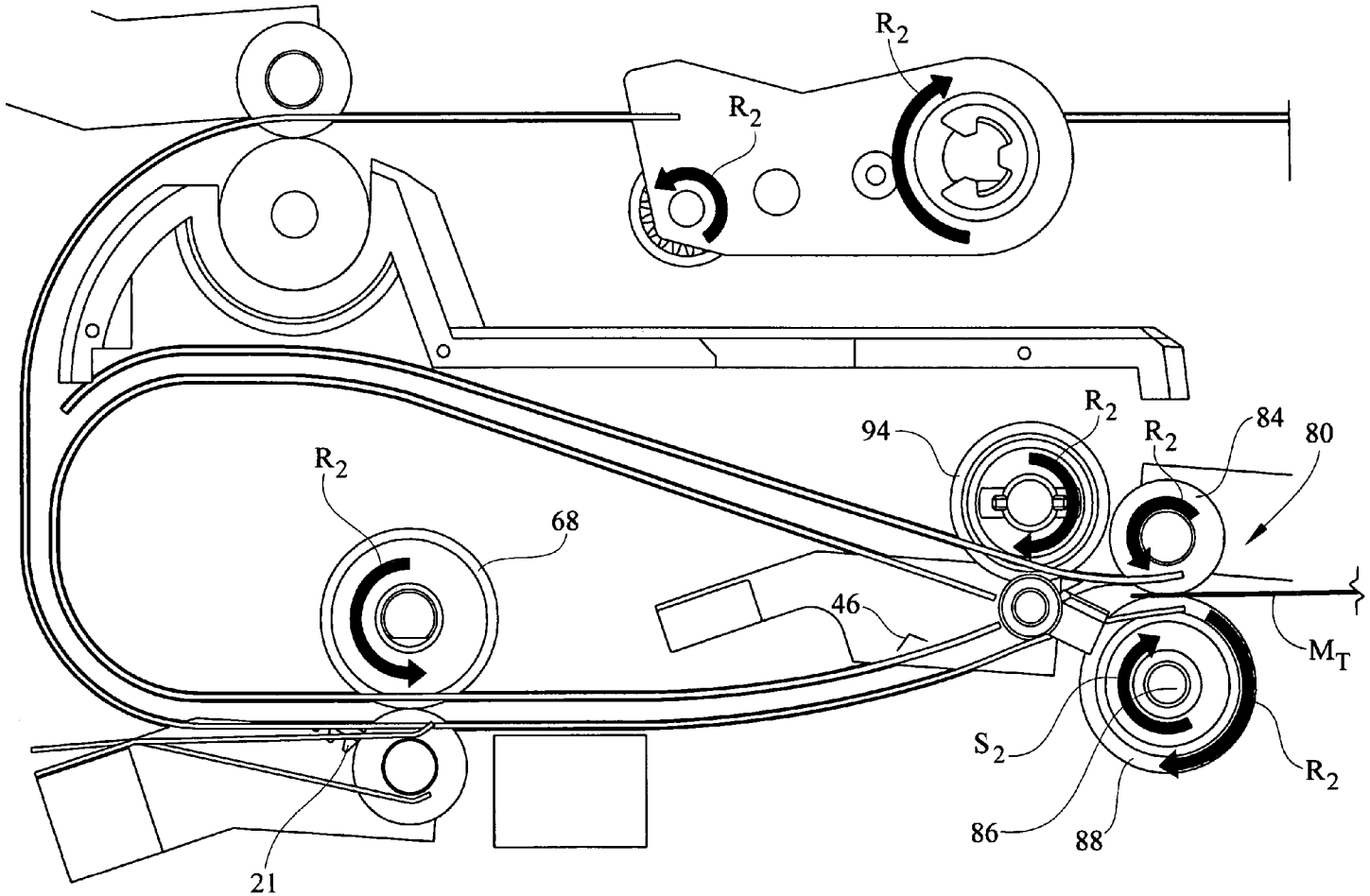

Referring now to FIG. 12, the media trailing edge $M_T$ is passing through the exit system, the feed roll 68 and duplexing feed roll 94 continue to rotate in a direction $R_2$ as indicated by the semi-circular arrow. The exit shaft 86 is also rotating in the direction $S_2$ which allows the roller 88 to rotate with the media engaged therewith depicted $R_2$. From this position the media M is ejected to the output or exit tray 19 (FIG. 1). The direction of rotation of the exit idler rolls 84 is now $R_2$. One of ordinary skill in the art will recognize that from the depicted position, the media M would be disposed second side down in the exit tray 19. Continued feeding of multiple sheets through the duplexing ADF device 30, would lead to improper collation within exit tray 19. In order to properly collate the media M in the exit tray 19, the media M must be passed through the duplex path 44 and around the switchback path after the duplex scan is performed. After this collation pass through the switchback path is performed, the media M are properly collated in the exit tray 19 with each media sheet M oriented first side down.

The present invention allows duplex scanning using a recirculation or switchback path wherein a media leading edge and a trailing edge pass through an exit system simultaneously without decreasing scan quality or inhibiting media feeding. The device provides an exit system with a friction drive roller system allowing the rollers to rotate either with the shaft or with media passing adjacent the roller depending on rotation of the exit shaft.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A duplexing auto-document feeder comprising:

an input tray;

a feedpath including a simplex path and a duplex path, said simplex path and said duplex path defining a switchback loop;

an image sensor in an optical communication with said feedpath; and an exit system comprising an exit shaft and a friction drive system having driven rollers wherein a media leading edge portion and a media wailing edge portion simultaneously pass through said exit system in opposite directions and said friction drive system comprising driven rollers mounted on said exit shaft wherein said friction drive system allows rotation of said driven rollers in a direction opposite to rotation of said exit shaft as said trailing edge and said leading edge pass through said exit system.

2. The duplexing auto-document feeder of claim 1, wherein said driven rollers of said friction drive system comprise a first roller, a second roller and a third roller.

3. The duplexing auto-document feeder of claim 2, wherein said first roller and said third roller are disposed against hubs located on said exit shaft.

4. The duplexing auto-document feeder of claim 3, further comprising a first biasing member disposed between said first roller and said second roller.

5. The duplexing auto-document feeder of claim 4, further comprising a second biasing member disposed between said second roller and said third roller.

6. The auto-document feeder of claim 2, wherein said first roller, said second roller and said third roller rotate with said exit shaft when said exit shaft rotates in a first direction and no media is present.

7. The auto-document feeder of claim 2, wherein said first roller, said second roller and said third roller rotate with media movement when said exit shaft rotates in a second direction.

8. A duplexing auto-document feeder, comprising:

a media feed system;

a feedpath including an input a switchback path for switching a media sheet from a first side to a second side and an exit system comprising an exit shaft and exit rollers mounted on said exit shaft; and a friction drive on said exit shaft providing motion of a media sheet through said exit system and into said switchback path and allowing relative motion between said exit shaft and said exit rollers.

9. The duplexing auto-document feeder of claim 8, wherein said friction drive allows said exit rollers rotation either with said exit shaft or with said media sheet passing through said exit system adjacent said exit rollers.

10. The duplexing auto-document feeder of claim 8, wherein said exit shaft is a reversing shaft.

11. The duplexing auto-document feeder of claim 8, said switchback path further comprising an entry and an exit at said exit system wherein a leading edge and a trailing edge of said media sheet simultaneously pass.

12. The duplexing auto-document feeder of claim 11, further comprising an exit drive roller, wherein said exit drive roller rotates with said leading edge of said media sheet and an exit idler rotates with said trailing edge of said media sheet.

13. A duplexing auto-document feeder, comprising:

a media input system and a media exit;

a feedpath extending between said input system and said media exit;

said feedpath having a simplex path and a duplex path forming a switchback loop;

said switchback loop in feeding communication with an exit system;

said exit system comprising an exit shaft and at least one roller mounted to and driven by said exit shaft wherein said at least one roller rotates with said exit shaft or with an adjacent media depending on a direction of rotation of said exit shaft; and wherein said exit system further comprises a friction drive system that allows relative motion between said exit shaft and said at least one roller.

14. The duplexing auto-document feeder of claim 13, wherein said at least one roller further comprises a first roller, a second roller, and a third roller.

15. The duplexing auto-document feeder of claim 14 further comprising a first hub and a second hub connected to said exit shaft, said first hub and said second hub frictionally engaging said first roller and said third roller, respectively.

16. The duplexing auto-document feeder of claim 15, wherein said first roller and said third roller rotate with said shaft or with said adjacent media.

17. The duplexing auto-document feeder of claim 14, wherein said second roller rotates with said exit shaft when said exit shaft rotates in one direction.

18. The duplexing auto-document feeder of claim 17, wherein said second roller rotates with a media passing said second roller when said exit shaft rotates in a second direction.

19. A duplexing auto-document feeder comprising:

an input tray;

a feedpath including a simplex path and a duplex path, said simplex path and said duplex path defining a switchback loop;

an image sensor in an optical communication with said feedpath; and an exit system comprising an exit shaft and a friction drive system having driven rollers wherein a media leading edge portion and a media trailing edge portion simultaneously pass through said exit system in opposite directions and said friction drive system allows rotation of said driven rollers in a direction opposite to rotation of said exit shaft as said trailing edge and leading edge pass through said exit system;

wherein said driven rollers of said friction drive system comprise a first roller, a second roller and a third roller, said first roller and said third roller are disposed against hubs located on said exit shaft, a first biasing member disposed between said first roller and said second roller, a second biasing member disposed between said second roller and said third roller.

20. The duplexing auto-document feeder of claim 8 further comprising driven rollers wherein said driver rollers of said friction drive system comprise a first roller, a second roller and a third roller, said first roller and said third roller are disposed are disposed against hubs located on said exit shaft, a first biasing member disposed between said first roller and said second roller, a second biasing member disposed between said second roller and said third roller.

21. The duplexing auto-document feeder of claim 15 further comprising a first biasing member disposed between said first roller and said second roller, a second biasing member disposed between said second roller and said third roller.

* * * * *